US008742435B2

(12) United States Patent
Tanaka et al.

(10) Patent No.: US 8,742,435 B2
(45) Date of Patent: Jun. 3, 2014

(54) LED LIGHTING DEVICE

(75) Inventors: Kenichiro Tanaka, Neyagawa (JP); Akira Fukuoka, Moriguchi (JP)

(73) Assignee: Panasonic Corporation, Osaka (JP)

( * ) Notice: Subject to any disclaimer, the term of this patent is extended or adjusted under 35 U.S.C. 154(b) by 78 days.

(21) Appl. No.: 12/933,486

(22) PCT Filed: Mar. 24, 2009

(86) PCT No.: PCT/JP2009/055761
§ 371 (c)(1),
(2), (4) Date: Sep. 20, 2010

(87) PCT Pub. No.: WO2009/119550
PCT Pub. Date: Oct. 1, 2009

(65) Prior Publication Data

US 2011/0018012 A1 Jan. 27, 2011

(30) Foreign Application Priority Data

Mar. 24, 2008 (JP) ..... 2008-076699

(51) Int. Cl.
*H01L 33/08* (2010.01)

(52) U.S. Cl.
USPC ..... 257/89; 257/79; 257/59; 257/82; 257/98; 257/E33.067; 438/27; 438/29; 438/478; 438/669; 438/795

(58) Field of Classification Search
USPC ..... 257/79, 59, 82, 98, 434, 435, 680, 345; 438/27, 29, 478, 669, 795
See application file for complete search history.

(56) References Cited

U.S. PATENT DOCUMENTS 4,146,883 A * 3/1979 Appeldorn et al. ..... 340/815.44
6,878,969 B2 * 4/2005 Tanaka et al. ..... 257/79

(Continued)

FOREIGN PATENT DOCUMENTS

| | | | |
|---|---|---|---|
| CN | 1790756 A | | 6/2006 |
| JP | 08-153405 A | | 11/1996 |
| JP | 10-106327 A | * | 4/1998 |
| JP | 2006-30322 A | | 2/2006 |
| JP | 2006-27886 A | * | 12/2006 |
| JP | 2008-27866 A | | 2/2008 |

OTHER PUBLICATIONS

International Search Report for the Application No. PCT/JP2009/055781 mailed Jun. 30, 2009.

(Continued)

*Primary Examiner* — Lex Malsawma
*Assistant Examiner* — Sheng Zhu
(74) *Attorney, Agent, or Firm* — McDermott Will & emery LLP

(57) ABSTRACT

The LED lighting device in this invention comprises a light source, a first face sheet, and a reflection sheet. The light source comprises a plurality of LED chips which are configured to emit lights having wavelengths which are different from each other. The first face sheet has a rear surface. The rear surface is defined as a diffusing and reflecting surface which is being configured to diffuse and reflect the lights which are emitted from the LED chips. The first face sheet is provided with a plurality of apertures. The reflection sheet has a second reflecting surface. The second reflecting surface is configured to reflect the light which is reflected from the diffusing and reflecting surface of the first face sheet toward the first face sheet. Each the aperture is shaped to pass the light which is reflected from the second reflecting surface. Each the aperture is configured to prevent the light which is directly emitted by the light from being passed through the aperture without being subjected to any reflection.

13 Claims, 8 Drawing Sheets

(56) References Cited

U.S. PATENT DOCUMENTS

| | | | | |
|---|---|---|---|---|
| 6,921,929 | B2 * | 7/2005 | LeBoeuf et al. | 257/100 |
| 7,148,470 | B2 * | 12/2006 | Rains et al. | 250/228 |
| 7,323,721 | B2 | 1/2008 | Liao et al. | |
| 7,530,711 | B2 * | 5/2009 | Bang | 362/241 |
| 7,915,679 | B2 * | 3/2011 | Erchak et al. | 257/345 |
| 2006/0049415 | A1 | 3/2006 | Liao et al. | |
| 2006/0291185 | A1 * | 12/2006 | Atsushi | 362/29 |
| 2009/0003002 | A1 * | 1/2009 | Sato | 362/341 |

OTHER PUBLICATIONS

The First Office Action for the Application No. 200980110348.3 from The State Intellectual Property Office of the People's Republic of China dated Mar. 22, 2012.

* cited by examiner

LED LIGHTING DEVICE

TECHNICAL FIELD

This invention relates to an LED lighting device using a light source comprising a plurality of LED chips being configured to emit the lights having wavelengths which is different from each other.

BACKGROUND ART

Japanese patent application publication No. 2008-27886A discloses a prior LED lighting device. The prior LED lighting device comprises a case, a light source, a light guide body, and an inner reflection surface. The case is shaped to have a box shape. The case has a bottom wall, and is formed at its center of the bottom with an opening. The light source is disposed within the opening. The light source 1 comprises a plurality of the LED chips which emit the lights having wavelengths which are different from each other. The LED chips are, for example, a combination of a red LED chip, a green LED chip, and a blue LED chip. The light guide body is made of a light transmissive material. The light transmissive material is realized by a polymer such as an acrylic resin and silicone resin. The light guide body is incorporated into the case. The light guide body is provided with a first reflection surface which is opposite to the bottom wall of the case. The first reflection surface is configured to reflect the light which is emitted from the light source in a predetermined ratio. The inner reflection surface is disposed between the light guide body and an inside of the case. The inner reflection surface is configured to reflect "the light which is emitted from the light source and subsequently is reflected by the first reflection surface".

DISCLOSURE OF THE INVENTION

Problem to be Resolved by the Invention

In the prior LED lighting device, an amount of the light which is emitted from the LED lighting device is reduced due to the light loss in the light guide body. In addition, in a case where the prior LED lighting device comprises the light source which has one kind of the LED chip, it is possible to obtain a uniform light to the large area. However, in the prior LED lighting device, the light emitted from the light source is reflected by the first reflection surface of the light guide body in the predetermined ratio. Therefore, a part of the light emitted from the light source is directly emitted to the outside of the LED lighting device, without any reflection. Therefore, if the light emitted from "the light source comprising a plurality of the LED chips which emit the lights having the wavelengths which are different from each other" has a color unevenness, the light which is emitted from the LED lighting device also has a color unevenness.

This invention is achieved to solve the above problem. An object in this invention is to produce the LED lighting device being configured to emit the light having no color unevenness.

Means of Solving the Problems

In order to solve the above problem, an LED lighting device in this invention comprises a light source 1, a first face sheet 2, and a reflection sheet 3. The light source 1 comprises a plurality of LED chips 10 which are configured to emit lights having wavelengths which are different from each other. The first face sheet has a front surface 210 and a rear surface 211. The rear surface is defined as a diffusing and reflecting surface being configured to diffuse and reflect the lights which are emitted from the LED chips. The first face sheet is disposed such that the rear surface is faced to the light source. The first face sheet has a center axis M1 and a plurality of apertures 21. Each the aperture 21 has a width b and a depth a. The width extends along a direction perpendicular to the center axis. The depth extends along the center axis. The reflection sheet has a second reflecting surface 223. The reflection sheet 3 is disposed such that the second reflecting surface is faced to the rear surface of the first face sheet. The reflection sheet is spaced from the first face sheet by a predetermined distance. The second reflecting surface is configured to reflect "the light which is reflected by said diffusing and reflecting surface" toward said first face sheet. The light source is disposed to pass through the center axis. The apertures are configured to pass the light which is reflected by said second reflecting surface. Each the apertures has a shape so as not to pass the light which is emitted and directly traveled from said light source to said apertures. Consequently, the light which is emitted from said light source is not passed through said aperture without being subjected to any reflection.

In this case, it is possible to obtain the LED lighting device being configured to emit the light having no color unevenness.

It is preferred that each the aperture has an inside surface. The inside surface is configured to diffuse and reflect the light which is emitted from the light source. Consequently, "the light which is emitted from said light source" is diffused and reflected by the inside surface of the aperture to direct toward an outside of the LED lighting device.

In this case, it is also possible to obtain the LED lighting device being configured to emit the light having no color unevenness.

It is preferred that the reflecting sheet is spaced from said first face sheet by the predetermined distance such that the reflecting sheet leaves a space between said first face sheet and said reflecting sheet. The space is filled with air.

In this case, the light which is reflected by the first face sheet and the reflecting sheet is emitted toward the outside of the LED lighting device through the space which is filled with the air. That is, it is possible to prevent the attenuation of the light which is emitted from the light source by the air which fills the space. Therefore, it is possible to obtain the LED lighting device being configured to emit a large amount of the light.

It is preferred that each the aperture has an opening dimension. The opening dimension is perpendicular to the center axis M1. The opening dimensions of the apertures are made smaller toward the center axis. Each the aperture 21 is shaped to have an aspect ratio. Aspect ratio is determined by a ratio of the depth a to the width b. The aperture is shaped to have the aspect ratio so as not to directly pass "the light which is emitted from said light source" without any reflection.

In this case, it is possible to prevent "the light which is directly emitted from the light source" toward the outside of the LED lighting device without any reflection in the inside surface of the apertures in the near side of the light source. That is, it is possible to prevent the light which is directly emitted from the light source from being passed toward the outside of the LED lighting device through the aperture.

It is preferred that the depths of the apertures are made greater toward the center axis. Each the aperture is shaped to have an aspect ratio which is determined by a ratio of said depth to said width. The aperture is shaped to have the aspect ratio so as not to directly pass "the light which is emitted from said light source" without any reflection.

Also in this case, it is possible to prevent the light which is directly emitted from the light source from being emitted to the outside of the LED lighting device without any reflection by the inside surface located on the near side of the light source. That is, it is possible to prevent the light which is directly emitted from the light source from being emitted toward the outside of the LED lighting device through the aperture.

It is preferred that each the apertures has a first inside surface 21*a* and a second inside surface 21*b*. The second inside surface is faced the first inside surface. The first inside surface is located on a near side of the center axis. Each the width becomes smaller toward the rear surface from the front surface. The second inside surface extends in parallel to the center axis.

In this case, it is possible to reduce the differences of the brightness of the lights which is emitted from each the apertures.

It is preferred that each the aperture has an opening dimension. The opening dimensions of the apertures is smaller the nearer the apertures are to the center axis. Each the aperture has a first inside surface and a second inside surface. The second inside surface is faced to the first inside surface. Each the opening dimension becomes smaller toward the rear surface from the front surface. The second inside surface extends in parallel to the center axis.

Also in this case, it is possible to reduce the differences of the brightness of the lights which is emitted from each the apertures.

It is preferred that each the aperture has a periphery with a far portion which is located far away from the center axis than a rest of the aperture. The face sheet further comprises reflecting walls 22. Each the reflecting wall extends toward a front direction from each the far portion.

In this case, it is possible to prevent the light which is directly emitted from the light source from being directly emitted to the outside of the LED lighting device, certainly.

It is preferred that the LED lighting device further comprises a light guide plate 6. The light guide plate is disposed on the front surface of the face sheet.

In this case, it is possible to reduce the differences of the brightness of the lights which are emitted from a plurality of the apertures.

It is preferred that the light guide plate has a fixing surface and an exposed surface 212. The fixing surface is attached to the front surface of the face sheet. The exposed surface is opposite of the fixing surface. The exposed surface is shaped to have a convex-concave profile.

In this case, it is possible to obtain the LED lighting device being configured to emit a large amount of the light to the outside of the LED lighting device.

It is preferred that the LED lighting device further comprises a second face sheet 7. The second face sheet has a front surface and a rear surface. The rear surface is defined as a diffusing and reflecting surface being configured to diffuse and reflect the light which is emitted from the LED chips. The second face sheet is shaped to have a plurality of second apertures each of which has a width and a depth. The second face sheet is opposite of the LED chips from the first face sheet. Each the second aperture is shaped to pass the light which is reflected by the second reflecting surface. Each the second aperture has a shape so as not to pass "the light directly from the light source" without any reflection.

In this case, it is possible to prevent the light which is directly emitted from the light source from being emitted to the outside of the LED lighting device, certainly. In addition, it is possible to reduce the difference of the brightness of the lights.

It is preferred that the LED lighting device further comprises a spacer 4. The spacer is disposed between the first face sheet and the reflection sheet such that the spacer makes a space between the first face sheet and the reflection sheet. The first face sheet is cooperative with the reflection sheet and the spacer to define a housing.

These and still other objects and advantages will become apparent from the following detail description referring to the attached drawings.

BEST MODE FOR CARRYING OUT THE INVENTION

First Embodiment

Figure 1:
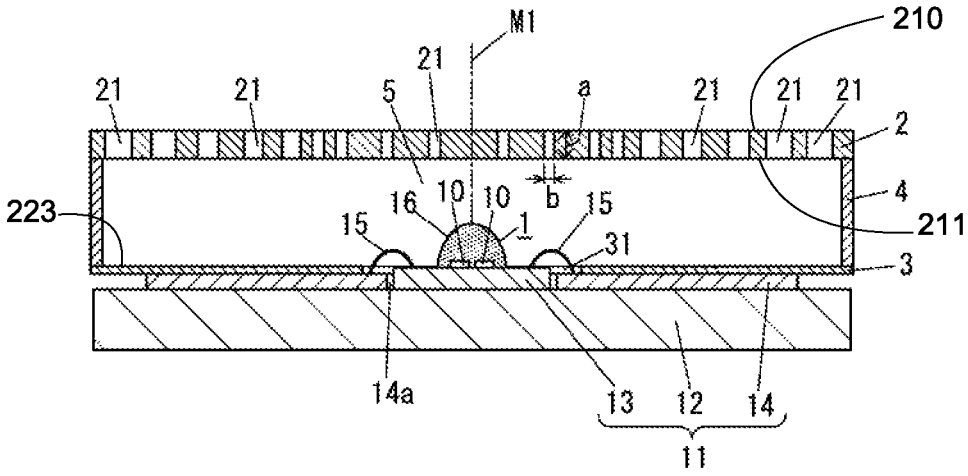
FIG. 1 shows a schematic side cross sectional view of the LED lighting device in the first embodiment.

The LED lighting device in this embodiment is shown in FIG. 1. The LED lighting device comprises a light source 1, a face sheet 2, a reflection sheet 3, and a spacer 4. The light source 1 comprises a plurality of LED chips 10. A plurality of the LED chips 10 are configured to emit the lights which have wavelengths, respectively, which are different from each other. The face sheet 2 is shaped to have a rectangular plate shape with a plurality of apertures 21. The face sheet 2 is realized by a diffusing and reflecting sheet of being configured to diffuse and reflect the light. The reflection sheet 3 is shaped to have a rectangular plate shape. The reflection sheet 3 is disposed in an opposed relation to the face sheet 2. The reflection sheet 3 is configured to diffuse and reflect the light which is diffused and reflected from the face sheet 2. The spacer 4 is shaped to have a frame shape. Specifically, the spacer 4 is shaped to have a rectangular frame shape. The spacer 4 is interposed between the face sheet 2 and the reflection sheet 3. Each aperture 21 is provided for passing the light. As shown in FIG. 1, the face sheet 2 has a front surface 210 and a rear surface 211. The face sheet 2 is disposed such that the rear sheet 211 is faced to the light source. The front surface 210 is opposite to the rear surface. The face sheet 2 has a thickness extending along a direction from the rear surface 211 to the front surface 210. The face sheet 2 has a center axis M1 which extends along the thickness direction of the face sheet 2. The light source 1 is aligned with the center axis M1. A medium between the face sheet 2 and the reflection sheet 3 is an air. The face sheet 2 has a plurality of the apertures 21 so as not to pass the light directly from the light source 1 to the outside of the LED lighting device. In addition, a plurality of the apertures 21 are provided for uniforming a brightness of the location on a light output surface side. Specifically, the apertures 21 are shaped to pass the light which is reflected by the reflection sheet 3. In addition, the apertures 21 are shaped to have an inside surface which is configured to reflect the light which is emitted from the light source 1, whereby the apertures 21 are also configured to pass the light which is reflected by the inside surface of the apertures 21. That is, the face sheet has the apertures so as not to pass the light directly from the light source, without any reflection. In addition, the face sheet 2 is spaced from the reflection sheet 3 by the spacer 4. Therefore, a layer filled with the air is formed between the face sheet 2 and the reflection sheet 3. The face sheet 2 is cooperative with the reflection sheet 3 and the spacer 4 to construct the housing. It is noted that the shape of the spacer 4 is not limited to the frame shape. It is possible to employ the pillar shaped spacers instead of the frame shaped spacer. In this case, the pillar shaped spacers are located at four corners of the face sheet 2 and the reflection sheet 3.

Each the LED chip 10 of the light source 1 is mounted on the first surface of one mounting substrate 11. The LED chips 10 are encapsulated by the light transmissive member which is shaped to have a lens shape. (The light transmissive member is made of material such as silicone resin, epoxy resin, acrylic resin, polycarbonate resin, and glass.) The mounting substrate 11 comprises a heat conductive plate 12, a sub mount substrate 13, and a wiring substrate 14. The heat conductive plate 12 is made of material such as Cu and Au. The heat conductive plate 12 is shaped to have a rectangular plate shape. The sub mount substrate 13 is joined to a center of a first surface of the heat conductive plate 12. The sub mount substrate 13 is shaped to have a rectangular shape. The sub mount substrate is made of material such as AlN. The wiring substrate 14 is joined to the center of the first surface of the heat conductive plate 12. The wiring substrate 14 is formed with an opening 14*a* for placing the placing the sub mount substrate 13 within the opening 14*a* such that an entire inside surface of the wiring substrate 14 is spaced from the sub mount substrate 13. The wiring substrate 14 is joined to the reflection sheet 3. The sub mount substrate 13 is shaped to have the rectangular plate shape. The sub mount substrate has a stress relaxation function of relaxing the stress applied to the LED chip 10 caused by the difference of the coefficient of linear expansion between the LED chip 10 and the heat conductive plate 12. The sub mount substrate also has a heat conductive function of transferring the heat which is generated in the LED chip 10 to the heat conductive plate 12 which is larger than the size of the LED chip 10.

In addition, each the LED chip 10 has a second surface which is faced to the sub mount substrate 13, and is provided at its second surface with a patterned conductor. The patterned conductor of each the LED chip 10 is electrically coupled to each patterned circuit of the wiring substrate 14 via bonding wires 15. The wiring substrate 14 has a projected portion (which is not shown in the Figures) in a planar view. The projected portion extends toward an outer circumference of the heat conductive plate 21. The projected portion of the wiring substrate is electrically coupled to wirings which is provided for supplying the electrical power generated by the power source. The wiring substrate 14 is, for example, realized by an electrically insulation substrate which is provided at its first surface with patterned wirings for supplying the electrical power to each the LED chips 10. The electrically insulation substrate is made of material such as glass epoxy resin (FR4, FR5) and a paper phenol which comprises a paper which is impregnated with the phenol.

The light source 1 comprises a plurality of LED chips 10 which are configured to emit the lights having wavelengths which is different from each other. A plurality of LED chips 10 is realized by a red LED chip, a green LED chip, a blue LED chip, and a yellow LED chip. The red LED chip is configured to emit a red light. The green LED chip is configured to emit a green light. The blue LED chip is configured to emit a blue light. The yellow LED chip is configured to emit a yellow light. The red light is mixed with the green light, the blue light, and the yellow light to produce a white light. It is noted that the number of the LED chip 10 is not limited thereto. Furthermore, the colors of the LED chips are not limited thereto, too. It is possible to determine the number of the LED chip 10 and the color of the LED chips according to the desired mixed color of the light.

The spacer 4 is, as with the face sheet 2 and the reflection sheet 3, realized by a diffusing and reflecting sheet which is configured to reflect the light which is emitted from the light source 1. However, there is no need to employ the spacer which is realized by the diffusing and reflecting sheet.

The diffusing and reflecting sheet, which is used as the face sheet 2, the reflection sheet 3, and the spacer 4, is realized by a light reflection plate. The light reflection plate is, specifically, a light reflection plate with ultra fine foamed surface. The light reflection plate is made of a polyethylene terephthalate. The light reflection plate is foamed by a plurality of ultra fine air bubbles. The ultra fine air bubbles have diameters of equal to or less than 10 micrometers. The light reflection plate is exemplified by MCPET (registered trademark). However, it is possible to employ the light reflection plate other than MCPET. That is, the sheet having a high diffuse reflectivity and a high total reflectivity is capable of being employed as the light reflection plate. Therefore, it is possible to employ the sheet which is provided at its surface with a diffusing and reflecting film as the light reflection plate. In this embodiment, each one of the face sheet 2, the reflection sheet 3, and the spacer 4 is realized by the diffusing and reflecting sheet. Therefore, the rear surface of the face sheet 2 diffuses and reflects the light which is emitted from the light source 1. In addition, the inside surface of each the apertures 21 of the face sheet 2 also has a property of diffusing and reflecting the light which is emitted from the light source 1. Furthermore, the front surface of the reflection sheet 3 is configured to diffuse and reflect the light, being reflected from the face sheet 2, toward the face sheet 2. That is, the front surface of the reflection sheet 3 acts as the second reflection surface 223. Each one of the face sheet 2, the reflection sheet 3, and the spacer 4 in this embodiment has a diffusing reflectivity which is higher than a diffusing reflectivity of each the face sheet 2, the reflection sheet 3, and the spacer 4 which has a reflection surface realized by a metallic mirror surface. In addition, each one of the face sheet 2, the reflection sheet 3, and the spacer 4 in this embodiment has the total reflectivity which is higher than a total reflectivity of each one of a face sheet 2, the reflection sheet 3, and a spacer 4 which has a reflection surface realized by a metallic mirror surface. Therefore, it is possible to obtain the LED lighting device being configured to emit the light to the outside of the LED lighting device. That is, it is possible to improve an amount of the light which is output from the LED lighting device.

The reflection sheet 3 is formed at its center with an opening 31. The opening 31 is provided for placing the sub mount substrate 13 on the wiring substrate 14. The inside circumference surface of the opening 31 is spaced from the sub mount substrate 13.

Figure 2:
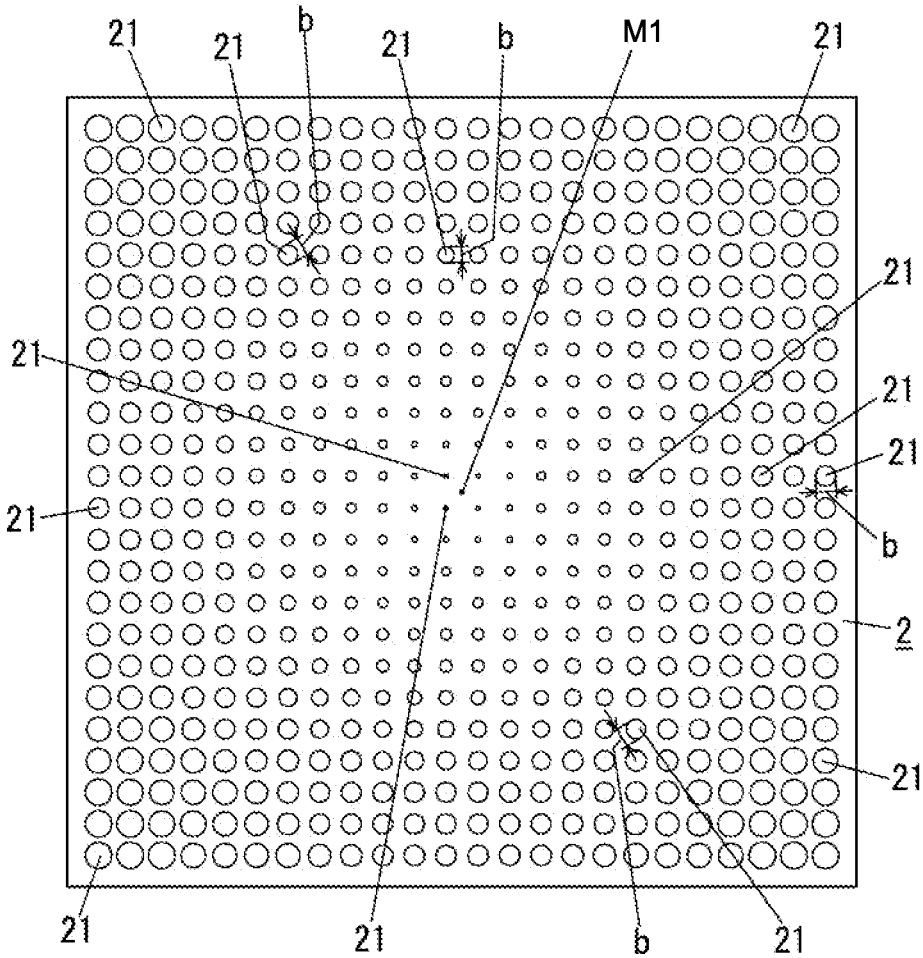
FIG. 2 shows a planar view of the face sheet in the first embodiment.
Figure 3:
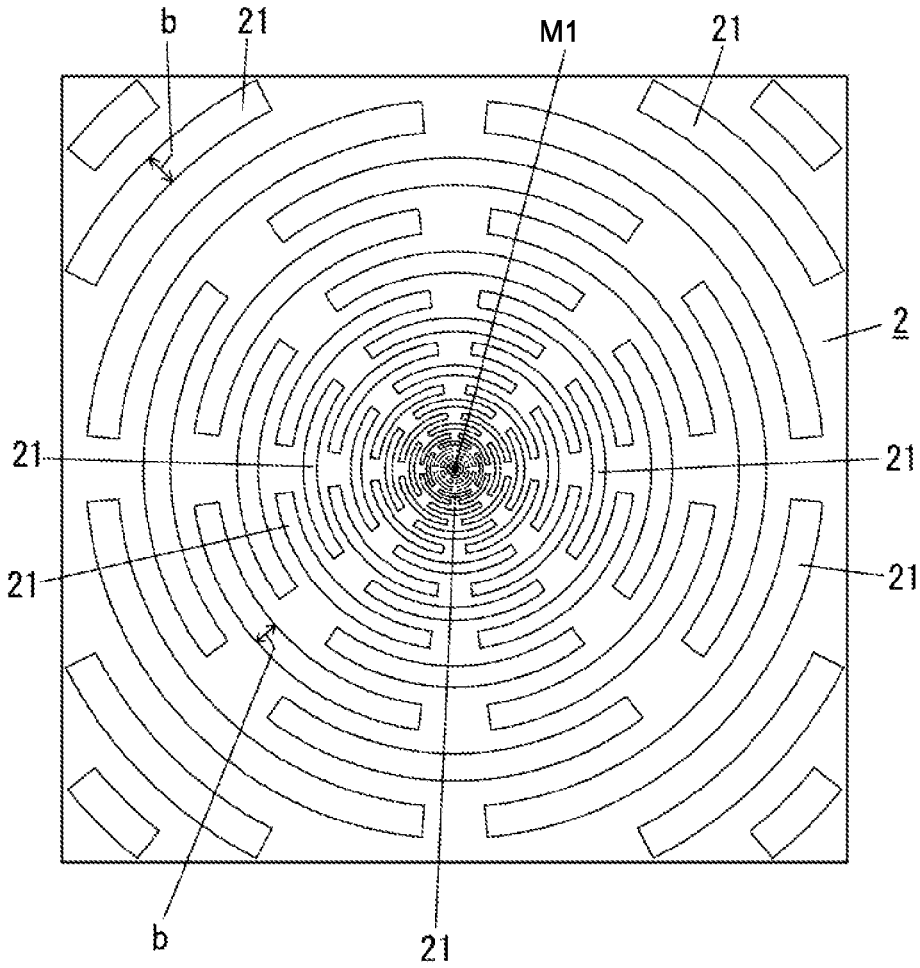
FIG. 3 shows a planar view of another face sheet in the above.

The face sheet 2 is formed with the apertures 21 such that the light which is emitted from the light source 1 is prevented to be directly emitted to the outside of the LED lighting device. In addition, the face sheet 2 is formed with the apertures 21 so as to uniform the brightness of the light output surface of the face sheet 2. As shown in FIG. 1 and FIG. 2, each the aperture 21 has an opening dimension. The opening dimension is in parallel with a plane which is perpendicular to the center axis M1. The apertures 21 are smaller the nearer the apertures are to the light source 1. The aperture 21 has a width and a depth. The width of the aperture 21 is perpendicular to the center axis M1. The depth extends along the center axis M1. Therefore, the shape of the aperture has an aspect ratio of the depth a to the width b. The value of the aspect ratio is calculated according to the following formula. Formula: [Aspect ratio]=[Thickness a of the periphery of the aperture 21]/[Opening width b of the aperture 21] That is, [Aspect ratio]=[Depth a of the aperture 21]/[Opening width b of the aperture 21] In this embodiment, the aperture 21 has a circular shape. The opening width being larger the larger the distance of the apertures are from the center axis M1. However, it is noted that the shapes of the apertures 21 are not limited to the circular shape. It is possible to employ a face sheet 2 formed with a plurality of apertures 21 each of which has an opening width b gradually being larger the larger the distance of the apertures are from the center axis M1, in FIG. 3.

In the LED lighting device, the light which is emitted from the light source 1 is diffused and reflected by the rear surface 211 of the face sheet 2, whereby the light is emitted from the light source 1 is reflected from the rear surface 211 to the reflection sheet 3. The light which is reflected from the rear surface 211 of the face sheet 2 is also reflected by a top surface of the reflection sheet 3, whereby the light which is reflected from the rear surface 211 of the face sheet is also reflected from the face sheet 2. The light which is reflected from the reflection sheet 3 is passed through the apertures 21, and passed outward of the LED lighting device. In addition, each the apertures are shaped to have the aspect ratio which prevents the light which is emitted by the light source 1 from being passed outward without any reflection. Therefore, the light which is emitted by the light source 1 directly is reflected by the inside surface of the apertures 21. The light which is reflected from the inside surfaces of the apertures 21 is reflected to the outside of the LED lighting device. Therefore, this configuration makes it possible for the light which is emitted from the light source 1 to be passed outward of the LED lighting device without any reflection.

As mentioned above, the LED lighting device in this embodiment comprises the face sheet 2 and the reflection sheet 3. The face sheet 2 is realized by a diffusing and reflecting sheet which is formed with a plurality of the apertures 21. The face sheet 2 has the center axis M1 which extends along the thickness direction of the face sheet. The reflection sheet 3 is disposed so as to be faced to the rear surface of the face sheet 2. The reflection sheet 3 is realized by the diffusing and reflecting sheet being configured to diffuse and reflect the light, being diffused and reflected by the face sheet 2, to the face sheet 2. The medium between the face sheet 2 and the reflection sheet 3 is the air. Therefore, it is possible to emit the light outward of the LED lighting device through the apertures 21. In addition, the face sheet 2 is provided with apertures 21 being shaped so as not to directly pass the light which is emitted from the light source 1, and whereby the brightness of the light output surface is uniformed. Therefore, it is possible to prevent the color unevenness of the light emitted by the LED lighting device even if the light source 1 emits the light having the color unevenness due to a plurality of the LED chips 10 which are configured to emit lights having the wavelengths which are different from each other. In addition, the LED lighting device in this embodiment comprises the spacer 4. The spacer 4 is disposed between the face sheet 2 and the reflection sheet 3. The spacer 4 is shaped to have a frame shape. The spacer 4 is also made of the diffusing and reflecting sheet. Therefore, it is possible to obtain the LED lighting device being configured to emit a large amount of the light outward of the LED lighting device.

Furthermore, in the LED lighting device of the present embodiment, the face sheet 2 has a plurality of the apertures having the opening dimensions being smaller the nearer the apertures are to the center axis M1. In other words, the face sheet 2 has a plurality of the apertures having the opening dimensions being smaller the nearer the apertures are to the light source 1. Each the aperture is shaped to have the aspect ratio so as not to directly pass the light which is emitted by the light source 1. Therefore, it is possible to prevent the light which is emitted by the light source 1 from being directly emitted outward of the LED lighting device through the apertures 21, without being subjected to any reflection. That is, it is possible to prevent the light which is directly emitted from the light source 1 from being emitted to the outside of the LED lighting device through the apertures 21.

In addition, in the LED lighting device, each the LED chips 10 are configured to generate the heat when the light source 1 is turned on. The heat in the LED chips 10 are transferred to the heat conductive plate 12 through the sub mount substrate 13 without transferring to the wiring substrate 14. That is, the heat radiation property is improved. Therefore, it is possible to prevent the increase of the junction temperature of each the LED chips 10. As a result, it is possible to increase an input electrical power which is supplied to the LED chips 10. Therefore, it is possible to increase a light output of the light which is emitted from each the LED chips.

Second Embodiment

Figure 4:
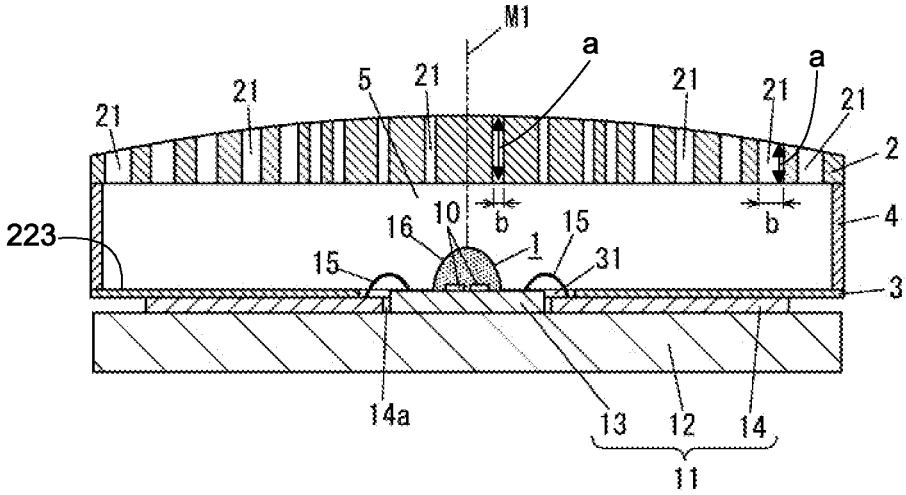
FIG. 4 shows a schematic side cross sectional view of the LED lighting device in the second embodiment.

An LED lighting device in this embodiment is approximately same as the LED lighting device in the first embodiment. The LED lighting device in this embodiment is shown in FIG. 4. The LED lighting device in this embodiment is different from the LED lighting device in the first embodiment in the structure of the face sheet 2. The components in this embodiment same as the components in the first embodiment is designated by the same reference numerals, whereby the explanation of the components in this embodiment same as the components in the first embodiment is omitted.

The face sheet 2 in this embodiment has a thickness. The thickness becomes greater toward the center axis M1. Consequently, the apertures 21 have the thicknesses which is smaller the nearer the apertures are to the center axis. In addition, each the aperture 21 is shaped to have the aspect ratio so as not to directly pass the light which is emitted from the light source 1. The aspect ratios of the apertures 21 in this embodiment are also determined according to the formula in the first embodiment. The thickness of the inside surface, in the distant portion from the center axis M1 of each the apertures 21 of the face sheet 2 is used as the thicknesses a of the peripheries of the apertures 21 of the face sheet 21.

In the above explained LED lighting device in this embodiment, the shapes of the apertures 21 and the opening dimensions of the apertures 21 being determined as the first embodiment makes it possible to surely prevent the light which is emitted by the light source 1 from being emitted outside of the LED lighting device without any reflection by the apertures 21 being located closer to the light source 1. Therefore, it is possible to prevent the light being emitted by the light source 1 from being directly emitted outward of the LED lighting device through the apertures 21.

Third Embodiment

Figure 5:
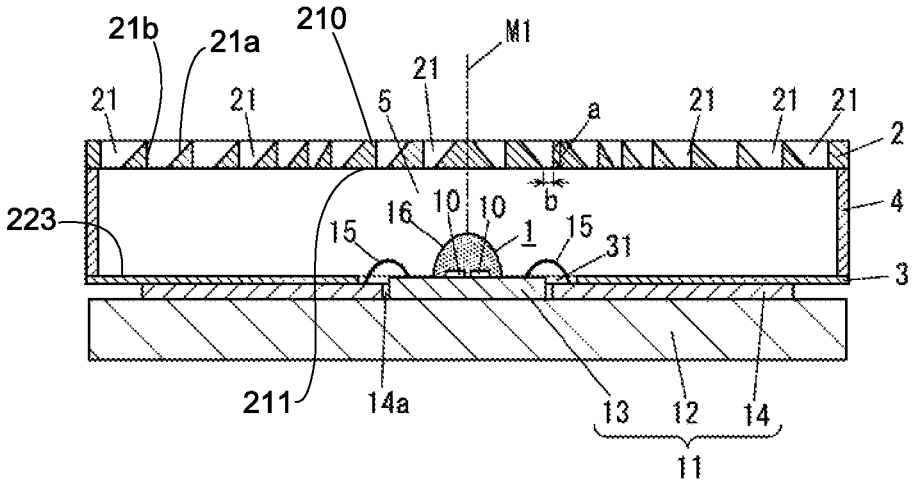
FIG. 5 shows a schematic side cross sectional view of the LED lighting device in the third embodiment.

An LED lighting device in this embodiment is almost same as the LED lighting device in the first embodiment. FIG. 5 shows the LED lighting device in this embodiment. The LED lighting device in this embodiment is different from the LED lighting device in the first embodiment in the structure of the face sheet 2. The components in this embodiment same as the components in the first embodiment is designated by the same reference numerals, whereby the explanation of the components in this embodiment same as the components in the first embodiment is omitted.

The face sheet 2 in this embodiment has the apertures 21. Each the apertures 21 has a first inside surface 21*a* and a second inside surface 21*b*. The first inside surface 21*a* is located at a closer side of the center axis M1. The second inside surface 21*b* is located so as to be faced to the first inside surface 21*a*. Each the aperture 21 has a width b which gradually becomes smaller toward the rear surface 211 from the front surface 210 of the face sheet 2. Similarly, the opening dimension of each the aperture 21 gradually becomes smaller toward the rear surface 211 from the front surface 210 of the face sheet 2. The second inside surface 21*b* is in parallel with the center axis. That is, the first inside surface is inclined at a predetermined angle with respect to the center axis M1.

With this configuration, it is possible to reduce the difference of the brightnesses in the portions of the LED lighting devices. It is noted that it is possible to employ the face sheet 2 with the apertures having the shapes same as the shapes of the apertures 21 of the face sheet in the second embodiment.

Fourth Embodiment

Figure 6:
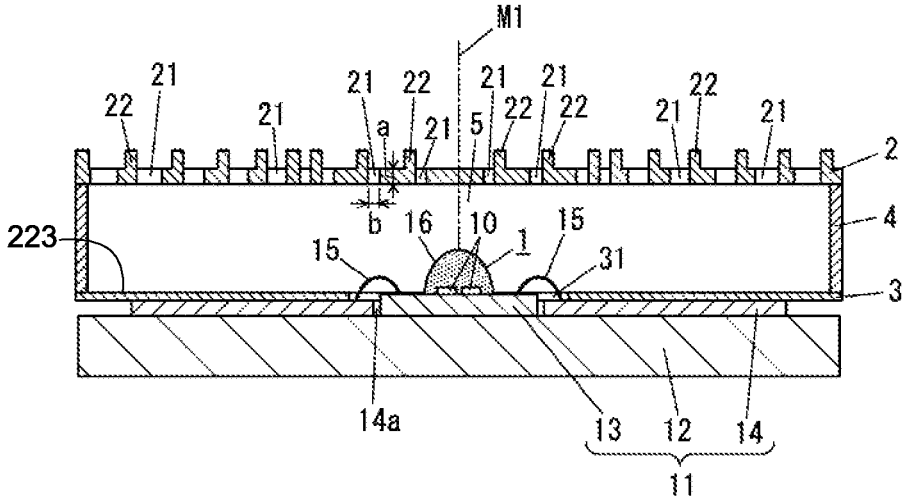
FIG. 6 shows a schematic side cross sectional view of the LED lighting device in the fourth embodiment.

The LED lighting device in this embodiment is almost same as the LED lighting device in the first embodiment. FIG. 6 shows the LED lighting device in this embodiment. The LED lighting device in this embodiment is different from the LED lighting device in the first embodiment in a structure of the face sheet 2. The components in this embodiment same as the components of the first embodiment is designated by the same reference numerals, whereby the explanation of the components in this embodiment same as the components of the first embodiment is omitted.

The face sheet 2 in this embodiment is formed with reflecting walls 22. Each the reflecting wall 22 extends from a far portion, from the center axis M1, of the periphery in the light output surface of each the aperture 21. Each the reflecting wall 22 extends along a thickness direction of the face sheet 2.

In the LED lighting device in this embodiment, the light which is passed through the apertures 21 is reflected by the reflecting wall 22 even if the light which is emitted by the light source 1 is passed through the apertures 21 without any reflection. Therefore, this configuration assures the prevention of the pass of the light which is directly emitted outside of the LED lighting device.

Fifth Embodiment

Figure 7:
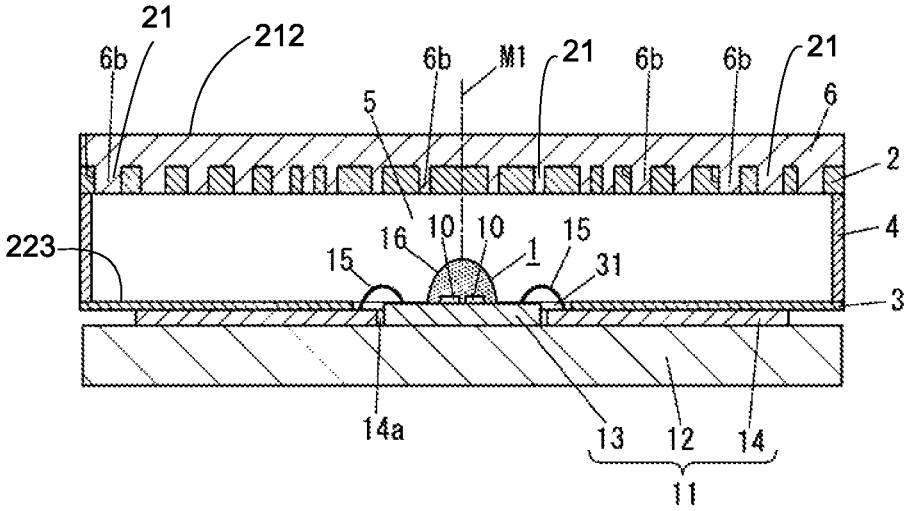
FIG. 7 shows a schematic side cross sectional view of the LED lighting device in the fifth embodiment.

An LED lighting device in this embodiment is almost same as the LED lighting device in the first embodiment. The LED lighting device in this embodiment is different from the LED lighting device in the first embodiment in a light guide plate 6 shown in FIG. 7. The light guide plate 6 is shaped to have a rectangular plate shape. The light guide plate 6 is disposed on the light output surface of the face sheet 2. The light guide plate 6 is formed to have a plurality of light guide portions 6*b* which is integral with the light guide plate 6. Each the light guide portion 6*b* is disposed so as to fill each the aperture 21. The components in this embodiment same as the components in the first embodiment is designated by the same reference numerals, whereby the explanation of the components in this embodiment same as the components in the first embodiment is omitted.

The light guide plate 6 is provided with a fixing surface. The light guide plate 6 is attached to the front surface of the face sheet via the fixing surface. In addition, the light guide plate 6 is provided with an exposed surface which is located on opposite surface of the fixing surface. The light which passes through the apertures 21 is provided outward of the LED lighting device through the exposed surface 212. It is preferred to employ a thin light guide plate 6 in order to reduce the loss of the light by the light guide plate 6. Therefore, the thickness of the light guide plate is lower than the distance between the face sheet 2 and the reflection sheet 3. The light guide plate 6 is made of a glass. However, it is possible to employ the light guide plate 6 being made of material such as an acrylic resin, a silicone resin, an epoxy resin, and a polycarbonate resin.

Consequently, the LED lighting device in this embodiment is provided with the light guide plate 6 which is disposed on the light output surface of the face sheet 2. Therefore, the light which is provided outward of the face sheet 2 is guided by each the light guide plate 6. Therefore, this configuration makes it possible to further uniform the brightness of the LED lighting device.

In addition, it is preferred for the LED lighting device in this embodiment to have a light guide plate with the exposed surface 212 which is shaped to have a convex-concave profile. In this case, it is possible to obtain the LED lighting device being configured to provide more light. As a matter of course, it is possible to apply the light guide plate 6 in this embodiment to the LED lighting device to the second embodiment, the third embodiment, and the fourth embodiment.

Sixth Embodiment

Figure 8:
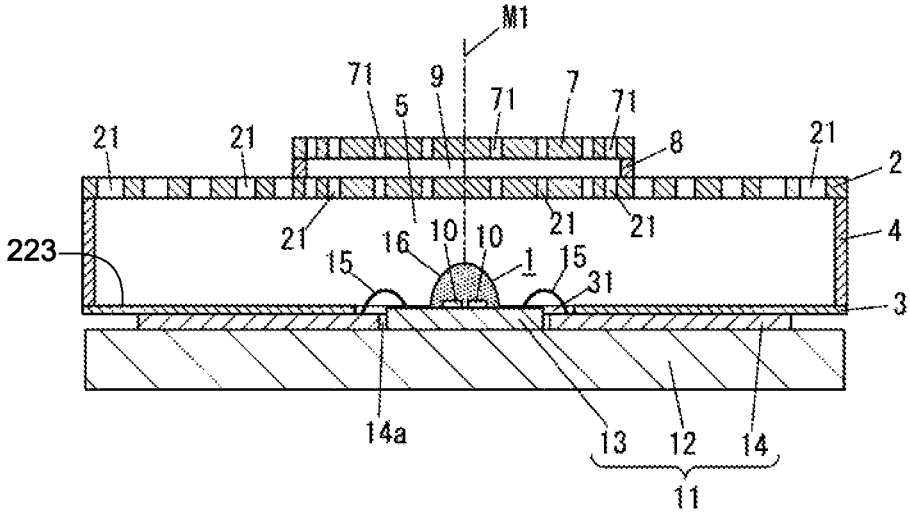
FIG. 8 shows a schematic side cross sectional view of the LED lighting device in the sixth embodiment.

An LED lighting device in this embodiment is almost same as the LED lighting device in the first embodiment. FIG. 8 shows the LED lighting device in this embodiment. The LED lighting device in this embodiment is different from the LED lighting device of the first embodiment in the following features. That is, the LED lighting device in this embodiment further comprises a second face sheet 7. The second face sheet 7 is spaced from the face sheet 2 so that the second face sheet 7 is disposed on the light output surface's side of the face sheet 2. The second face sheet 7 is provided with a plurality of second apertures 71. Each the second aperture 71 has a shape so as not to pass the light which is emitted from the light source 1 to the outside of the LED lighting device, whereby the brightness of the light output surface of the second face sheet 7 is uniformed. The components in this embodiment same as the components in the first embodiment is designated by the same reference numerals, whereby the explanation of the components in this embodiment same as the components in the first embodiment is omitted.

The second face sheet 7 is made from the diffusing and reflecting sheet, as with the face sheet 2. The second face sheet 7 is disposed in an opposed relation to the face sheet 8 by the spacer 8. Therefore, the second face sheet 7 and the face sheet 2 are disposed such that the air gap 9 is left between the second face sheet 7 and the face sheet 2. Each the second aperture has a width and depth. Each the second aperture 71 is aligned with each the aperture 21 corresponding to each the aperture 71. However, there is no need for each the apertures 71 of the face sheet 7 to have an opening shape same as the shape of each the aperture 21 of the face sheet 2. Also, there is no need for each the apertures 71 to be positioned within a projection domain of each the apertures 21 of the face sheet 2.

According to the LED lighting device in this embodiment, this configuration more assures the prevention of that the light which is emitted by the light source 1 is directly provided outward of the LED lighting device. In addition, this configuration more assures the uniform of the brightness of the LED lighting device. The LED lighting device in this embodiment employs the second face sheet 7 which has a dimension which is smaller than a dimension of the face sheet 2. However, as a matter of course, it is possible to employ the face sheet 2 having a dimension which is equal to the dimension of the face sheet 2.

Although the present invention is described with particular reference to the above illustrated embodiments, the present invention should not be limited thereto, and should be interpreted to encompass any combinations of the individual features of the embodiments.

The invention claimed is:

1. An LED lighting device comprising:

a light source comprising a plurality of LED chips which are configured to emit lights having wavelengths which are different from each other;

a first face sheet having a front surface and a rear surface, said rear surface being defined as a diffusing and reflecting surface being configured to diffuse and reflect the lights which are emitted from said LED chips, said first face sheet being disposed such that said rear surface is faced to said light source, said first face sheet having a center axis and a plurality of apertures, each of said plurality of apertures having a width which extends along a direction perpendicular to the center axis and a depth along the center axis; and a reflection sheet having a second reflecting surface, said reflection sheet being disposed such that said second reflecting surface is faced to said rear surface of said first face sheet, said reflection sheet being spaced from said first face sheet by a predetermined distance, said second reflecting surface being configured to reflect lights reflected by said diffusing and reflecting surface, toward said first face sheet, wherein:

said light source is aligned with said center axis, the first face sheet is a sheet closest to the reflection sheet, said first face sheet has said plurality of apertures through which the lights reflected by said second reflecting surface passes, each of said plurality of apertures having a shape so as not to pass a light which is emitted and directly traveled from said light source to said plurality of apertures, whereby none of the light which is emitted from said light source passes through said aperture without being subjected to any reflection, and each of said plurality of apertures has an opening dimension which is perpendicular to the center axis, said opening dimensions of said plurality of apertures being made smaller toward said center axis, each of said plurality of apertures is shaped to have an aspect ratio which is determined by a ratio of its own depth to width, and each of said plurality of apertures being shaped to have an aspect ratio so as not to directly pass the light, being emitted from said light source, without any reflection.

2. The LED lighting device as set forth in claim 1, wherein:

each of said plurality of apertures has an inside surface which diffuse and reflect the lights emitted from said light source, and the lights emitted from said light source is diffused and reflected by said inside surface of said aperture and are directed toward an outside of said LED lighting device.

3. The LED lighting device as set forth in claim 1, wherein:

said reflecting sheet is spaced from said first face sheet by the predetermined distance so as to leave a space between said first face sheet and said reflecting sheet, and said space is filled with air.

4. The LED lighting device as set forth in claim 1, wherein said depths of said plurality of apertures are made greater toward said center axis.

5. The LED lighting device as set forth in claim 1, wherein:

each of said plurality of apertures has a first inside surface and a second inside surface which is faced to said first inside surface, said first inside surface being located on a near side of the center axis, each of said widths becomes smaller toward said rear surface from said front surface, and said second inside surface extends in parallel to said center axis.

6. The LED lighting device as set forth in claim 1, wherein:

each of said plurality of apertures has a periphery with a far portion which is located far way from said center axis than a rest of said aperture, and said face sheet further comprises reflecting walls, each of said reflecting walls extending toward a front direction from each said far portions.

7. The LED lighting device as set forth in claim 1, wherein said LED lighting device further comprises a light guide plate which is disposed on said front surface of said face sheet.

8. The LED lighting device as set forth in claim 7, wherein:

said light guide plate has a fixing surface attached to said front surface of said face sheet, and an exposed surface opposite to said fixing surface, and said exposed surface is shaped to have a convex-concave profile, whereby a light extraction effect is improved.

9. The LED lighting device as set forth in claim 1, wherein:

said LED lighting device further comprises a second face sheet, said second face sheet having a front surface and a rear face which is defined as a diffusing and reflecting surface being configured to diffuse and reflect the lights which is emitted from said LED chips, said second face sheet being shaped to have a plurality of second apertures each of which has a width and a depth, said second face sheet is opposite to said LED chips from said first face sheet, each of said plurality of second apertures is shaped to pass the light which is reflected by said second reflecting surface, and each of said second plurality of apertures has having a shape so as not to pass the light directly from said light source, without any reflection.

10. The LED lighting device as set forth in claim 1, wherein:

said LED lighting device further comprises a spacer, said spacer being disposed between said first face sheet and said reflection sheet so as to leave a space between said first face sheet and said reflection sheet, and said first face sheet, said reflection sheet and said spacer define a housing.

11. The LED lighting device as set forth in claim 1, wherein the plurality of LED chips are encapsulated by a light transmissive member having a lens shape.

12. The LED lighting device as set forth in claim 1, wherein a thickness of the first face sheet is made greater toward the center axis.

13. An LED lighting device comprising:

a light source including a plurality of LED chips which are configured to emit lights having wavelengths which are different from each other;

one or more of face sheets, each having a front surface and a rear surface, the rear surface being configured to diffuse and reflect the lights emitted from the light source, and each being disposed such that the rear surface faces the light source, the one or more of face sheets having a center axis and a plurality of apertures; and a reflection sheet having a reflecting surface and disposed such that the reflecting surface faces the rear surface of one of the one or more of face sheets closest to the reflection sheet, the reflection sheet being spaced from the one of the one or more of face sheets closest to the reflection sheet by a predetermined distance, the reflecting surface being configured to reflect lights reflected by the rear surface of the one of the one or more of face sheets closest to the reflection sheet toward the one of the one or more of face sheets closest to the reflection sheet, wherein:

the light source is aligned with the center axis, the plurality of apertures of the one of the one or more of face sheets closest to the reflection sheet are configured such that no direct light which are emitted from the light source and which are not reflected by the rear surface, the reflection sheet or inside surfaces of the plurality of apertures of the one of the one or more of face sheets closest to the reflection sheet passes through the plurality of apertures of the one of the one or more of face sheets closest to the reflection sheet.

* * * * *